US005645689A

United States Patent [19]

Ruf et al.

[11] Patent Number: 5,645,689

[45] Date of Patent: Jul. 8, 1997

[54] MULTILAYER HEADBOX

[75] Inventors: Wolfgang Ruf, Heidenheim; Frank Fey, Schwäbisch Gmünd; Thomas Dietz, Königsbronn; Klaus Pimiskern, Daisendorf; Gerhard Wernlein, Eriskirch, all of Germany

[73] Assignee: Voith Sulzer Papiermachinen GmbH, Heidenheim, Germany

[21] Appl. No.: 557,719

[22] Filed: Nov. 13, 1995

[30] Foreign Application Priority Data

Nov. 10, 1994 [DE] Germany ..... 44 40 079.9

[51] Int. Cl.[6] ..... D21F 1/02

[52] U.S. Cl. ..... 162/258; 162/259; 162/343; 162/344; 162/347; 162/DIG. 10; 162/DIG. 11

[58] Field of Search ..... 162/336, 343, 162/344, 345, 258, 259, 347, 301, DIG. 10, DIG. 11

[56] References Cited

U.S. PATENT DOCUMENTS

| | | | |
|---|---|---|---|
| 4,617,091 | 10/1986 | Rodal et al. | 162/343 |
| 4,891,100 | 1/1990 | Hildebrand | 162/343 |
| 4,909,904 | 3/1990 | Kinzler | 162/343 |
| 5,316,383 | 5/1994 | Begemann et al. | 366/160 |

FOREIGN PATENT DOCUMENTS

| | | |
|---|---|---|
| 2127855 | 1/1995 | Canada . |
| 2131440 | 4/1995 | Canada . |
| 147350 | 3/1989 | European Pat. Off. . |
| 250726 | 10/1987 | Germany . |
| 3807629 | 9/1989 | Germany . |
| 4323263 | 1/1994 | Germany . |
| 4329810 | 6/1994 | Germany . |
| 4323050 | 2/1995 | Germany . |

*Primary Examiner*—Peter Chin

*Attorney, Agent, or Firm*—Marshall, O'Toole, Gerstein, Murray & Borun

[57] ABSTRACT

A multilayer headbox for the introduction of at least two fiber suspension streams to the forming section of a paper manufacturing machine includes a nozzle chamber further defined by two stream guide walls which end at an outlet gap and by two side walls. At least one lamella is provided in the nozzle chamber, this lamella keeping at least two fiber suspension streams separated from each other through the region of the outlet gap. The lamella includes a body, preferably made of plastic, and a tip made of a hard material. The tip is either a strip or a coating having a sharp tip-edge integrated into the body of the lamella.

23 Claims, 3 Drawing Sheets

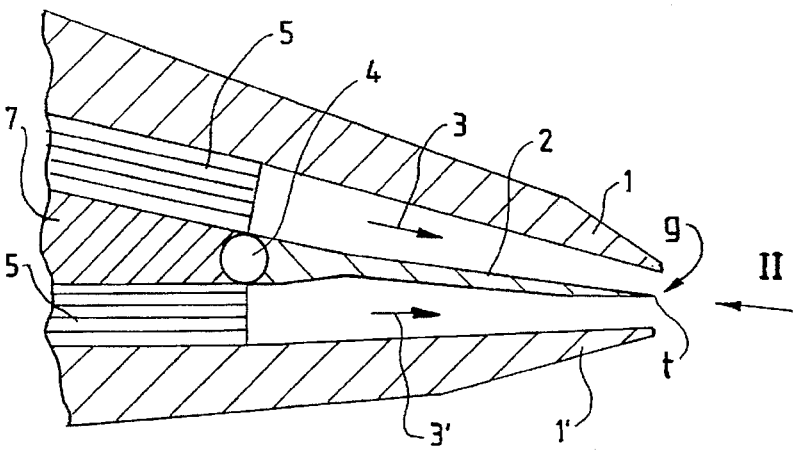
FIG. 1
FIG. 2
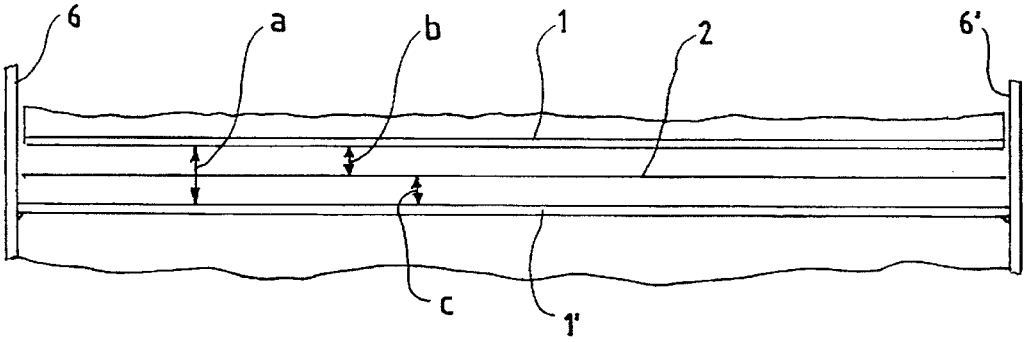
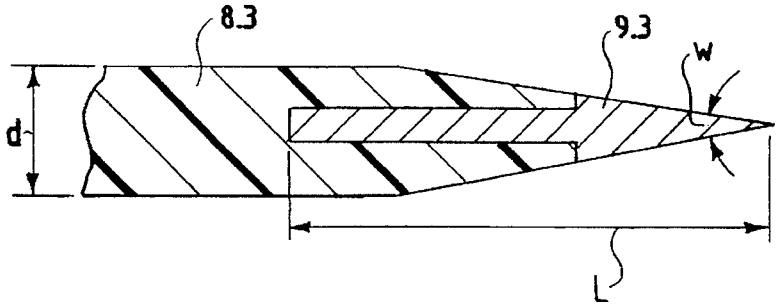
FIG. 3
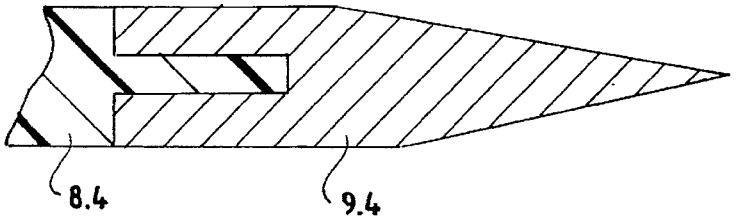
FIG. 4

MULTILAYER HEADBOX

BACKGROUND OF THE INVENTION

1. Field of the Invention

The invention relates to paper manufacturing machines and in particular to a nozzle chamber of a multilayer headbox of such a machine.

2. Description of Related Technology

A multilayer headbox of a paper manufacturing machine utilized for the introduction of at least two fiber suspension streams to a forming section of a paper manufacturing machine, each suspension stream spanning across a width of the machine, is disclosed in DE 43 29 810. Such a machine includes a nozzle chamber having a machine-wide outlet gap at a downstream portion thereof with respect to a direction of fluid flow through the machine. The nozzle chamber is defined by two machine-wide stream guide walls and two side walls. The guide walls terminate in the vicinity of the outlet gap of the nozzle chamber.

The headbox disclosed in DE 43 29 810 also includes at least one machine-wide lamella having a body portion and a tip made from a hard material. The lamella is disposed in the nozzle chamber and separates at least two fiber suspension streams flowing through the headbox all the way to the outlet gap. The function of the lamella is to keep the two fiber suspension streams separated so that no mixing of the different streams occurs until the streams are ultimately combined into a single stream in as undisturbed form as possible. Thus, no disturbances should occur in the stream. In this connection, the design of the end of the lamella must be taken into consideration, because the area about the lamella end is frequently the origin of flow disturbances. Various attempts have been made to avoid such disturbance in the fluid flow. Among others, according to DE 43 23 050 A1, it has been proposed to design the lamella in such a way as to cause an increased convergence in the flow channel, so that, as a result of an increase in the flow velocity in the vicinity of the lamella end, there results a reduction of disturbances due to frictional turbulence.

Regarding the constructional design of the end of the lamella, until now the opinion prevailed that the end of the lamella should not be made very sharp for reasons of manufacturing technology, costs and operational safety. However, a blunt lamella end may produce flow turbulence or periodic separations of turbulent flow, and as a consequence, vibrations are transferred to the end of the lamella or to the entire lamella. As a result, disturbances occur in the formation of the paper web and/or local undesirable mixing of neighboring pulp streams may occur. Consequently, in the finished multilayer paper, the layers will no longer be clearly distinguished from one another at some points, for example, with regard to different colors.

An attempt to avoid these disadvantages is disclosed in DE 43 29 810 which teaches providing slits or grooves in the essentially blunt lamella end or applying a thin foil which protrudes beyond the lamella end. However, such measures have been found to not be fully satisfactory.

SUMMARY OF THE INVENTION

It is an object of the invention to overcome one or more of the problems described above.

It is also an object to the invention to design a lamella end of a multilayer headbox in such a way that the following requirements are fulfilled as much as possible:

1) The lamella end should have a uniform shape over the entire machine width such that the clearance height of each of the flow channels separated by the lamella is as close as possible to constant over the machine width;
2) In order to avoid separation of turbulences at an end thereof, the lamella should be narrowed as slimly as possible and should have a relatively sharp, knife-like edge; and
3) The relatively sharp edge of the lamella should be as insensitive to mechanical damage as possible and/or should be able to be reworked after such damage, for example, by grinding. This is especially important when the lamella protrudes from the headbox beyond the outlet gap.

Thus, according to the invention, a multilayer headbox of a paper manufacturing machine utilized for the introduction of at least two fiber suspension streams to a forming section of a paper manufacturing machine, each suspension stream spanning across a width of the machine, includes a nozzle chamber having a machine-wide outlet gap at a downstream portion thereof with respect to a direction of fluid flow through the machine. The nozzle chamber is defined by two machine-wide stream guide walls and two side walls. The guide walls terminate in the vicinity of the outlet gap of the nozzle chamber. The headbox also includes at least one machine-wide lamella having a body portion and a tip made from a hard material. The lamella is disposed in the nozzle chamber and separates at least two fiber suspension streams flowing through the headbox all the way to the outlet gap. The tip is made either from a strip or a coating. If made from a strip, the strip has a sharp tip-edge, the strip being integrated into the body of the lamella. If the tip is a coating, the lamella body is narrowed toward the coating forming the tip. The tip coating also is integrated into the lamella body at at least one of the two sides thereof, forming a sharp tip-edge.

Other objects and advantages of the invention will be apparent to those skilled in the art from the following detailed description taken in conjunction with the drawings and the appended claims.

BRIEF DESCRIPTION OF THE DRAWING

FIG. 1 is a schematic, partial sectional view of a headbox according to the invention.

FIG. 2 is a front view of the headbox shown in FIG. 1 looking in a direction II.

FIG. 3 is an enlarged schematic, partial view of a second embodiment of a headbox according to the invention.

FIG. 4 is an enlarged schematic, partial view of a third embodiment of a headbox according to the invention.

DETAILED DESCRIPTION OF THE INVENTION

Figure 5:
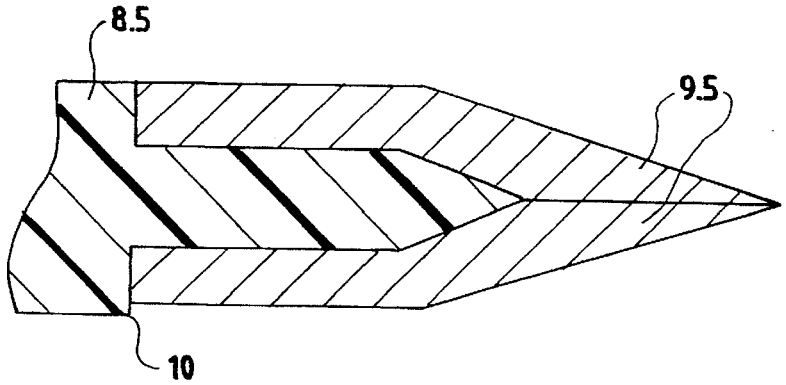
FIG. 5 is an enlarged schematic, partial view of a fourth embodiment of a headbox according to the invention.

According to the invention, a multilayer headbox is provided which includes a lamella disposed within a nozzle chamber so that at least two separate fiber suspension streams flow through the headbox nozzle, the tip of the lamella being made either from a strip or a coating. Regardless of whether the tip is a strip or a coating, it is made from a hard material, and in contrast to the prevailing idea discussed herein in the background of the invention, the tip is provided with a relatively sharp, knife-like tip-edge. Furthermore, there are several embodiments according to the invention wherein the tip is secured on the main portion of the lamella so that the tip can be provided with a sharp tip-edge by mechanical working after it is securely attached to the main portion of the lamella.

The strip, strips, or strip segments which constitute the tip of the lamella preferably are made from a hard ceramic material. Such ceramic strips are free from internal stresses, so that the finished lamella has extraordinary dimensional stability. However, it is also possible to use metals, for example, titanium, for the strips. However, in such an embodiment, as a rule, mechanical working of the metal is necessary with the danger of producing internal stresses in the strip or strip segments. Such mechanical working may result in the tip region of the finished lamella not having a straightness of required accuracy.

Therefore, in many cases, a preferred embodiment of a lamella tip according to the invention is a coated tip. In such an embodiment, the end region of the main portion (i.e., body) of the lamella has a form which narrows to an end thereof and this narrowed end region is covered with a coating made of a hard material, for example, a metal plate, so that the coating forms a tip about the narrowed end region which is then machined in such a way that a substantially sharp tip-edge is produced. This machining is preferably performed by grinding. An advantage of such a method is that the coating material does not have to be worked mechanically before securing it on the body of the lamella.

Also, in another preferred embodiment of a lamella tip according to the invention, a thin hard metal layer extends beyond the narrowed end of the lamella body portion and receives, again preferably by grinding, a sharp tip-edge at its free end. Such a method of production of a coated lamella tip is particularly preferred.

With reference to the drawing figures, FIG. 1 shows a schematic cross-section through a two-layer headbox according to the invention. FIG. 2 is a view of the outlet gap of the headbox looking in a direction of an arrow II of FIG. 1. FIGS. 3 to 8 show different embodiments of the lamella end region in a greatly enlarged representation in comparison to that shown in FIG. 1, each in cross-section.

A two-layer headbox is shown in FIG. 1, which itself is known in the art. FIG. 1 essentially shows only the region of the headbox called a nozzle chamber which guides two pulp streams, indicated by arrows 3 and 3' to an outlet gap, generally g. The streams 3 and 3' are as wide as the width of the machine itself. With reference to both FIGS. 1 and 2, the nozzle chamber is defined by two machine-wide stream guide walls 1 and 1' as well as by two side walls 6 and 6'. The two stream guide walls 1 and 1' are each connected to a middle stationary separating wall 7 which extends through a turbulence generator 5 known in the art. At a discharge end of the separating wall 7, a lamella 2 is attached so that the lamella 2 can swivel, for example, with the aid of a joint 4 that is connected to both the lamella 2 and the wall 7. In another embodiment according to the invention (not shown), the lamella 2 is rigidly secured to the separating wall 7. According to FIG. 1, the lamella 2 extends from the joint 4 to a region of the outlet gap g or alternatively, beyond the gap g (not shown). According to FIG. 2, the lamella extends over the entire width of the machine, that is, directly from one side wall 6 to the other side wall 6'. Thus, the lamella 2 separates the two pulp streams 3 and 3' from one another in the region of the outlet gap g. An alternative embodiment not shown in FIGS. 1 and 2 includes several lamellae disposed in the region of the outlet gap g so that more than two machine-wide pulp streams can be separated from one another.

The components of the headbox described so far, as it is well known, are produced very precisely, so that an inner width indicated by the double arrow a of the entire outlet gap is uniform across the width of the machine. If necessary, a locally deformable strip (not shown) is provided on the wall 1 in order to make the inner width a of the outlet gap more uniform.

The lamella 2 and especially an end thereof that terminates at a tip t, which is located in the region of the outlet gap g, must also be produced very precisely. This means that especially the tip t of the lamella end that protrudes should be as exactly straight-lined as possible from the side wall 6 to the other side wall 6', namely it should be as close as possible to being exactly parallel to the outlet ends of the stream guide walls 1 and 1'. The reason for this is that in order to achieve high paper quality, it is important that inner widths indicated by the double arrows b and c of the two partial outlet gaps forming the outlet gap g each be as constant as possible over the entire machine width. This goal is reached by, for example, the various special embodiments of the lamella tip shown in FIGS. 3 to 8.

Each of FIGS. 3 to 8 provide an enlarged partial view of a lamella according to the invention and thus show only an end portion of a lamella body, and a discrete tip portion, which is integrated into the lamella body end portion. The lamella body end portions shown in FIGS. 3 to 8 are indicated by the reference numerals 8.3 to 8.8, respectively, and the tip portions are indicated by the reference numerals 9.3 to 9.8, respectively. Each of the lamella body end portions 8.3 to 8.8 is preferably made of plastic. It is noted that in order to illustrate certain details of lamellae according to the invention shown in the embodiments of FIGS. 3 to 8, a thickness of a lamella indicated by a double arrow d is shown substantially enlarged (i.e., exaggerated) in relation to the length of the lamella. For example, with respect to FIG. 3, the thickness d is shown much larger with respect to a length L of the strip 9.3 than what would be the case for an actual lamella according to the invention. Thus, in reality, an angle w of the tip-edge shown in FIG. 3 is substantially smaller than what is shown in the drawing. An actual tip-edge according to the invention is therefore more like a knife blade.

According to FIGS. 3 to 5, the lamella tip is formed from a pre-manufactured one- or two-part strip 9.3, 9.4 and 9.5, respectively. According to FIG. 3, the strip 9.3 is glued into a groove of the lamella body end portion 8.3 with the aid of an appropriately shaped crosspiece. FIG. 4 shows a reverse example: here a crosspiece of the lamella body end portion 8.4 protrudes into a groove of the strip 9.4, which forms the tip. FIG. 5 shows a lamella body end portion 8.5 having a protruding crosspiece similar to what is shown with respect to element 8.4 of FIG. 4 except that the crosspiece narrows toward an end thereof. However, the strip 9.5 of the lamella shown in FIG. 5 is made of two pieces.

Figure 6:
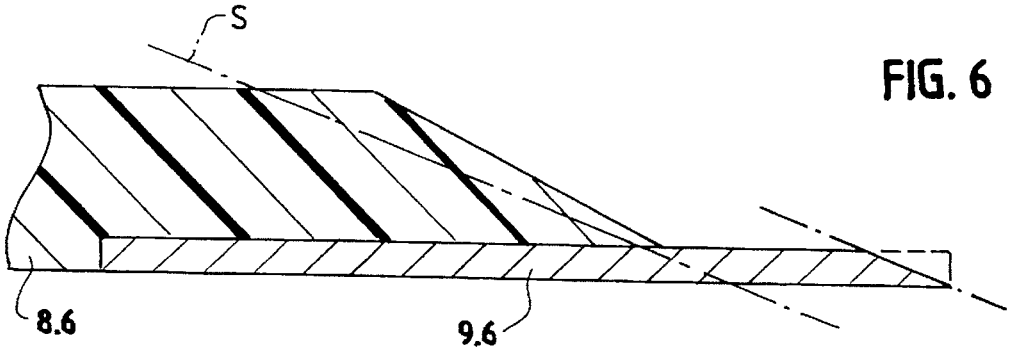
FIG. 6 is an enlarged schematic, partial view of a fifth embodiment of a headbox according to the invention.

According to FIG. 6, at the end of the lamella body end portion 8.6, a thin metal plate 9.6 is placed on one side of the body end portion 8.6. When viewed in cross-section, the metal plate 9.6 protrudes beyond a free end of the lamella body 8.6. The metal plate 9.6 is provided with a hard tip-edge by means of mechanical working, for example, by grinding a free end of the plate 9.6. In case of damage, the plate 9.6 can be reground. If necessary, the entire lamella end can be provided with a uniform slanting surface, for example, by grinding along a plane S.

Figure 7:
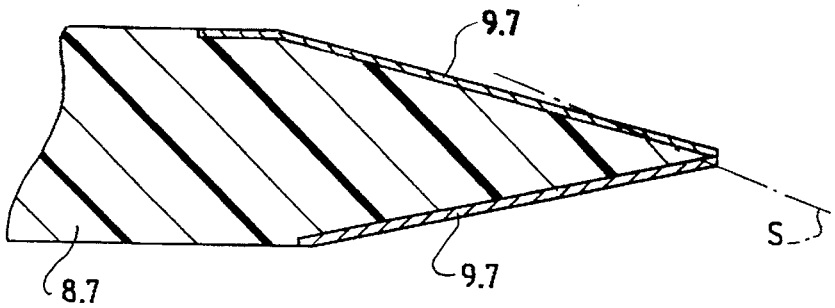
FIG. 7 is an enlarged schematic, partial view of a sixth embodiment of a headbox according to the invention.

According to FIG. 7, both sides of a narrowing end of the lamella body end portion 8.7 are provided with a hard outer layer 9.7, and then a sharp tip-edge is formed by grinding along a plane S'.

Figure 8:
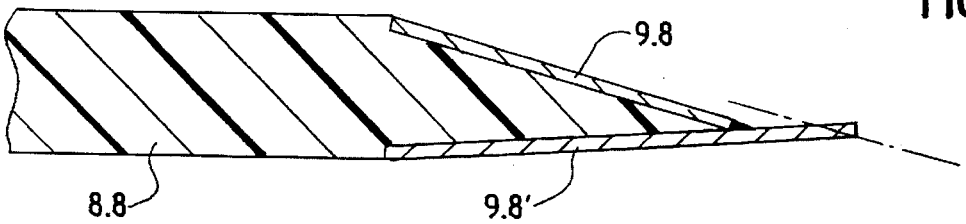
FIG. 8 is an enlarged schematic, partial view of a seventh embodiment of a headbox according to the invention.

According to FIG. 8, both sides of a narrowed end of the lamella body end portion 8.8 are coated with thin metal plate strips 9.8 and 9.8' of different widths. Here, it is essential that one of the metal strips 9.8' protrude beyond the other strip 9.8, so that the strip 9.8' alone forms the sharp tip end produced by grinding.

In all of the embodiments shown in FIGS. 1–8, the entire lamella is made of a material that is chemically stable to a high degree with respect to the pulp suspension flowing through the machine. As a result, the outer surfaces of the lamella, which comes into contact with the pulp, has a high smoothness so that the attachment of fibers or other pulp particles to the lamella can be avoided. Preferably, the outer surface of the lamella also is formed to have a smooth a transition as possible from the lamella body to the tip (the body preferably being made of plastic). However, under certain circumstances, a step 10 is provided at a transition between the lamella body and the tip; see FIG. 5.

According to another embodiment of the invention, the body of the lamella is made from a carbon-fiber-reinforced plastic. Such material imparts very high thermal stability to the lamella body. In other words, the shape of the lamella body remains substantially unchanged, even when it comes into contact with heated fibrous material suspension streams. Furthermore, the uniformity of the shape of a lamella end according to the invention can be maintained because the lamella tip is preferably formed by a relatively thin coating.

As already mentioned herein, one of the stream-guide walls 1 or 1' can be provided with a locally deformable strip. Such a strip, also called a "screen" is an aid that has been known for a long time for making uniform the area weight transverse profile of a paper web being produced in the machine. However, problems occur in the production of multilayer paper webs, especially when the covering layer is as thin as possible, but at the same time should uniformly cover the underlying layer. Namely, if local deformation of the screen of the headbox occurs, then deformation of the pulp jet leaving the headbox also occurs. In such a situation, the thickness of the outer layer is influenced which is undesirable as this thickness should remain constant.

An additional problem arising from utilizing a screen at the nozzle end of the headbox is that due to local deformation of the screen, the geometry of the nozzle end changes non-uniformly. Thus, uniform fanning out of the pulp jet occurs along the machine width which in turn leads to different degrees of mixing of the layers. This phenomena also leads to undesirable different influences of fiber orientation along the web width.

In addition to the above-stated disadvantages of a screen at a nozzle end of a headbox, such a screen displacement device further causes a problem in that the nozzle cannot be brought sufficiently close to the wire, especially when used in connection with twin-wire formers. As a result, an undesirably long, unguided pulp jet may be formed, which again results in reducing the quality of the pulp stream, especially when making multilayer papers.

Therefore, an important further development according to the invention is the preferable use of a lamella, having a sharp tip-edge, in a headbox which does not have a deformable strip screen or other similar device. Instead, according to the invention, one can make corrections of the area weight transverse profile by producing a local change in the concentration of the pulp suspension in a known manner, i.e., by sectional change of the suspension composition, especially of the pulp density. For this purpose, one can use various known systems, for example, the system according to DE 37 41 603 (corresponds to U.S. Pat. No. 4,909,904) or the system according to DE 43 23 263. However, with reference to FIG. 9, sectional mixing devices distributed along the width of the machine are preferred, for example, as according to DE 42 11 291 (corresponds to U.S. Pat. No. 5,316, 383). These are based on the principle that several sectional main streams (represented by lines 14) are present and are distributed over the width of the machine. A sectional side pulp stream with a different pulp density (represented by the lines 16) is admixed to each sectional main pulp stream. This is done in such a way, for example, by selection of a suitable "mixing angle" $\alpha$, that when the size of the side pulp stream changes, the size of the sectional mixed pulp stream (the lines 14') remains unchanged. As a result, at a certain point of the web width, local correction of the web area weight can be performed without changing the fiber orientation at this location.

Another advantage is that the nozzle end of the headbox can be designed very simply and thus requires only small expenditure in manufacturing technology. By omitting the screen-displacement devices, the headbox can be brought very close to the wire or can be introduced between the wires, as a result of which the free pulp jet can be greatly shortened and thus the quality of the multilayer paper increased even further.

Figure 9:
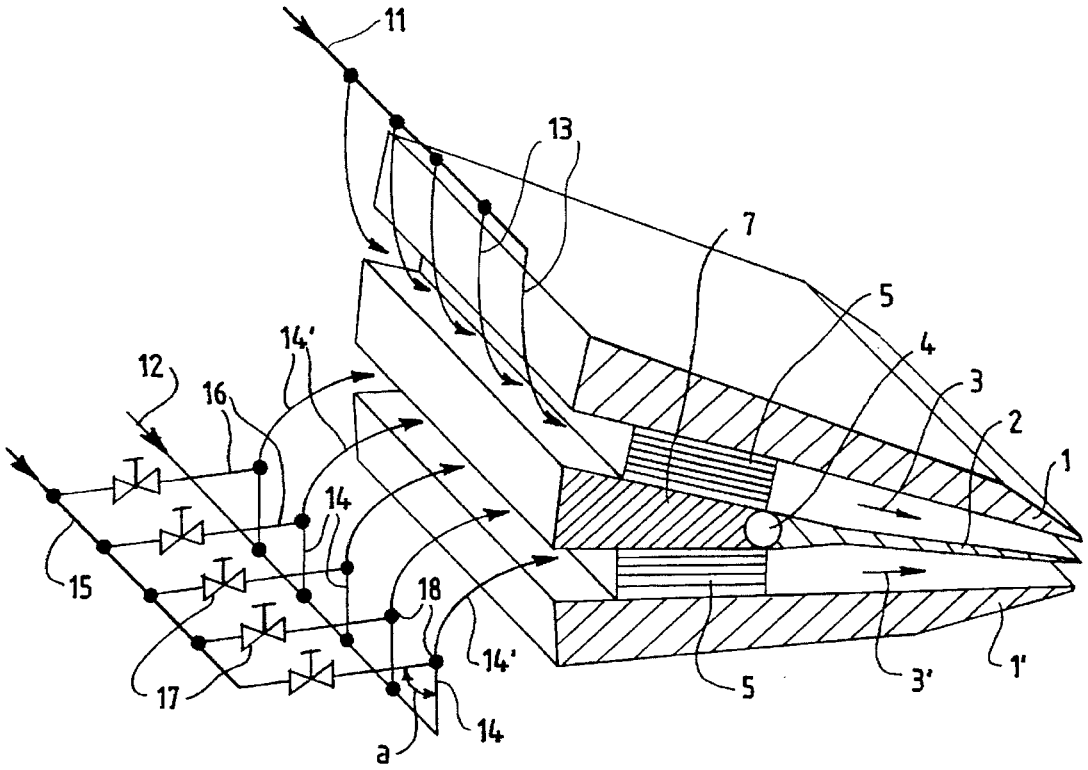
FIG. 9 is a schematic, partial view of the headbox of FIG. 1.

FIG. 9 shows a headbox as already described herein with respect to FIG. 1, together with a schematic piping system for the introduction of various fiber suspensions into the headbox. A first main pulp stream, consisting of a first paper pulp sort, arrives through a transverse distributing line 11 and through a number of sectional inlet lines 13, branched out from the line 11, flowing to one of the turbulence generators 5. A second main pulp stream, consisting of another sort of paper pulp, arrives through a transverse distributor line 12 and through a number of sectional inlet lines 14, 14', branched off from the line 12, flowing to the other turbulence generator 5. If necessary, in order that the area weight transverse profile of the paper web to be produced can be corrected, a third transverse distributor line 15 is provided for introducing a so-called side pulp stream. For example, this consists of dilution water or of the second sort of paper pulp, but with a different, preferably lower, pulp density. Several sectional inlet lines 16 are branched off from the transverse distributor line 15, each having a control valve 17. Each of the lines 16 thus introduces a controllable sectional side pulp stream to a mixing point 18, where the stream is mixed with a sectional main pulp stream. In deviation from FIG. 9, additionally the following could be provided: other inlet lines for the individually controllable sectional side pulp streams could open into the sectional inlet lines 13 for the first main pulp stream.

The foregoing detailed description is given for clearness of understanding only, and no unnecessary limitations should be understood therefrom, as modifications within the scope of the invention will be apparent to those skilled in the art.

We claim:

1. A multilayer headbox of a paper manufacturing machine, said headbox for the introduction of at least two fiber suspension streams to a forming section of the paper manufacturing machine, each suspension stream spanning across a width of the machine, said headbox comprising:

(a) a nozzle chamber having a machine-wide outlet gap at a downstream portion thereof with respect to a direction of fluid flow through the machine, said nozzle chamber defined by first and second machine-wide stream guide walls and first and second side walls, each guide wall having an end disposed at said outlet gap;

(b) at least one machine-wide lamella disposed in the nozzle chamber, said lamella separating at least two fiber suspension streams flowing through the headbox all the way to the outlet gap, said lamella having a body and a tip made from a hard material, said tip made from at least one of (i) a strip having a sharp tip-edge, said strip integrated into the body of the lamella, and (ii) a coating, said lamella being narrowed toward said coating forming the tip, said tip coating being integrated into the lamella at at least one of the two sides of the lamella, forming a sharp tip-edge.

2. The headbox of claim 1 wherein the body of the lamella is made from plastic.

3. The headbox of claim 1 wherein the lamella tip is a strip extending over the entire width of the machine.

4. The headbox of claim 1 wherein the lamella tip is a strip which is subdivided into segments along the machine width.

5. The headbox of claim 1 wherein the lamella tip is a strip made from a single piece with respect to a cross-section of the lamella body.

6. The headbox of claim 1 wherein the lamella tip is a strip which is in two pieces with respect to a cross-section of the lamella body.

7. The headbox of claim 1 wherein the lamella tip is a strip made of metal.

8. The headbox of claim 1 wherein the lamella tip is a strip made of a ceramic material.

9. The headbox of claim 1 wherein the lamella tip is a coating formed by a metal plate bonded to the lamella body.

10. The headbox of claim 9 wherein the metal plate is bonded to the lamella body utilizing glue.

11. The headbox of claim 1 wherein the lamella tip is a coating applied to the lamella body by evaporation.

12. The headbox of claim 1 wherein the lamella tip is a coating with the lamella body being coated on both sides thereof and the tip can be sharpened by mechanical working.

13. The headbox of claim 12 wherein the tip can be sharpened by grinding performed after coating the lamella body.

14. The headbox of claim 1 wherein the tip is formed by a metal plate disposed on one side of the lamella body, said metal plate extending beyond the end of the lamella body and can be sharpened by mechanical working.

15. The headbox of claim 14 wherein the metal plate can be sharpened by grinding.

16. The headbox of claim 14 wherein the other side of the end of the lamella body has a coating.

17. The headbox of claim 1 wherein the tip is integrated continuously, at least approximately hydraulically smoothly into the lamella body.

18. The headbox of claim 1 wherein an outside of the lamella has a step disposed at a transition from the body to the tip.

19. The headbox of claim 1 wherein the lamella tip is a coating, the narrowing lamella end has coatings on both sides thereof, and ends of the coatings are displaced from one another with respect to the direction of fluid flow through the headbox.

20. The headbox of claim 1 wherein the lamella tip is a strip and the lamella body is made of a thermally stable plastic.

21. The headbox of claim 20 wherein the thermally stable plastic is a carbon-fiber-reinforced plastic.

22. The headbox of claim 1 wherein a) ends of the stream guide walls are free of locally displaceable or deformable strips; and b) in order to correct an area weight transverse profile of a web to be produced by the machine, a plurality of flow lines are provided, distributed over the width of the machine, for admixing variable side pulp streams having a pulp density different from that of a main pulp stream.

23. The headbox of claim 22 further comprising means for keeping the density of the mixed pulp stream constant by changing the density of a side pulp stream.

* * * * *